United States Patent [19]

Olsen

[11] 3,952,435

[45] Apr. 27, 1976

[54] PHOTO FRAME AND THE LIKE

[75] Inventor: Daniel H. Olsen, Toledo, Ohio

[73] Assignee: Midland Insta-Change Company, Cincinnati, Ohio

[22] Filed: July 17, 1974

[21] Appl. No.: 489,232

[52] U.S. Cl. ..... 40/152.1
[51] Int. Cl.[2] ..... G09F 1/12
[58] Field of Search..... 40/152, 152.1, 5, 10 R; 248/465, 468

[56] References Cited

UNITED STATES PATENTS

| | | | |
|---|---|---|---|
| 1,807,213 | 5/1931 | Hopp | 40/5 |
| 2,047,075 | 7/1936 | Kremen | 248/465 |
| 2,521,411 | 9/1950 | Rosenberg et al. | 40/152.1 |
| 2,758,402 | 8/1956 | Fulmer | 40/152.1 |
| 2,826,843 | 3/1958 | Fabry | 40/152 |

*Primary Examiner*—Louis G. Mancene
*Assistant Examiner*—Wenceslao J. Contreras
*Attorney, Agent, or Firm*—Melville, Strasser, Foster & Hoffman

[57] ABSTRACT

A frame for photos and the like is composed basically of three elements: a recessed back plate; a front plate having a photo aperture in its front face and arranged for the insertion of a photo between the front and rear faces thereof, and held in position in said recessed back plate by magnetic means; and a back pan having means for attachment to the rear of said back plate, and having provisions for cooperating with various accessories, including an easel member, a message standard, a background card, or an elongated mounting member for a plurality of like frames.

4 Claims, 13 Drawing Figures

2
2

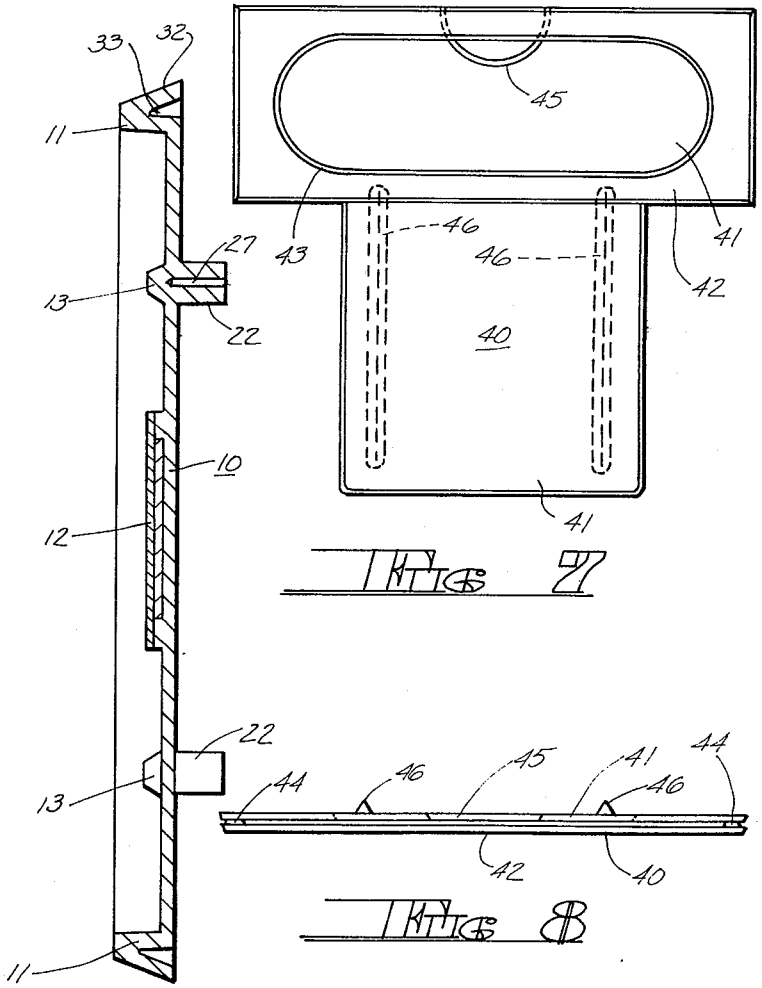
FIG. 7
FIG. 8
FIG. 6
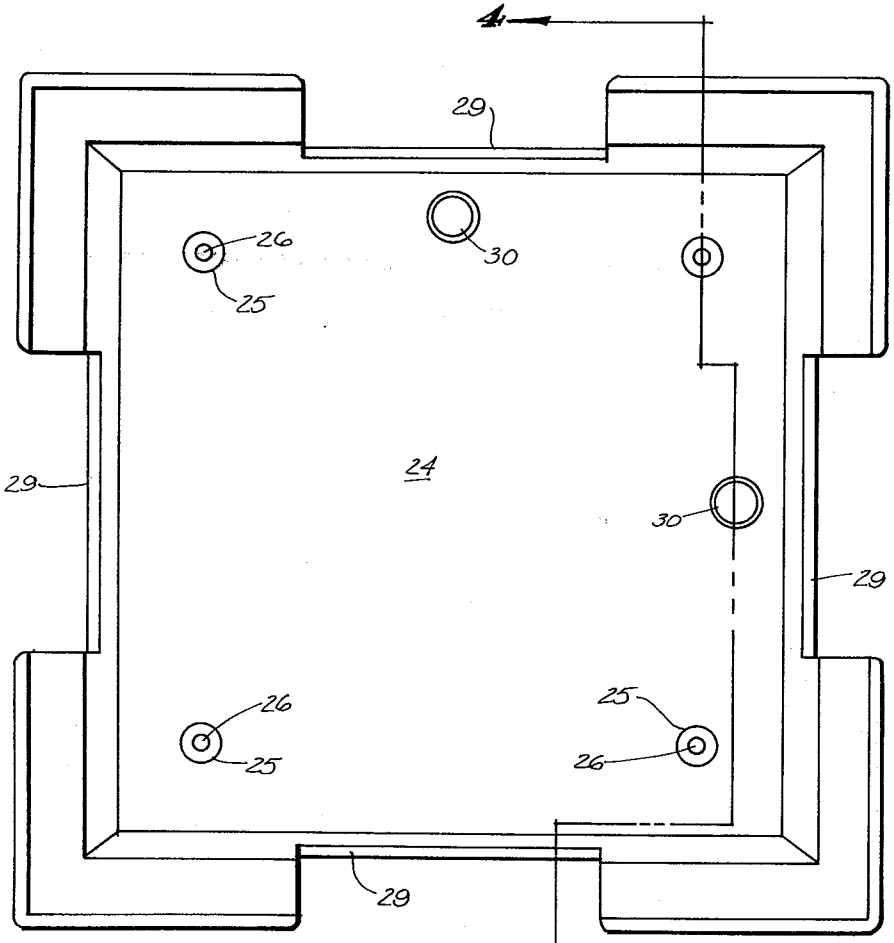
FIG. 3

PHOTO FRAME AND THE LIKE

CROSS REFERENCE TO RELATED APPLICATION

The present invention is related to a copending application Ser. No. 412,832 filed Nov. 5, 1973, now Patent No. 3,885,336, dated May 27, 1975, which was a continuation-in-part of an application, Ser. No. 321,134 filed Jan. 5, 1973 and now abandoned, in that it makes use of the basic frame disclosed therein.

BACKGROUND OF THE INVENTION

In said copending application there is disclosed a frame which makes the changing of photos or other matter to be displayed simple and quick and makes it possible to make changes without deterioration of the frame with usage.

The frame disclosed in said application comprises a recessed back plate and a front plate adapted to fit within said recess with clearance thereabout and held in said recess by magnetic means. The front plate has front and rear faces between which a photo may be inserted and the front plate has a photo aperture through which the photo may be viewed. Means are provided whereby the rear face of the front plate is spaced from the bottom of the recess in the back plate such that the front plate may be tipped manually relative to the rear plate when depressed adjacent one edge thereof, thereby allowing the front plate to be easily retrieved from the rear plate when the frames are assembled. Reference may be had to said copending application for the details of construction of the two-piece basic frame member. It will only be described herein to the extent necessary for an understanding of the present invention.

BRIEF SUMMARY OF THE INVENTION

The present invention provides a back pan for the frame of said copending application and means to secure the the back pan to the rear plate of the frame. The back pan is provided with means whereby it may be combined with various accessories such as an easel, a message standard, a background card, or whereby it may be mounted along with like frames on an elongated rail member and whereby it may be mounted fixedly on a wall.

BRIEF DESCRIPTION OF THE SEVERAL VIEWS OF THE DRAWINGS

FIG. 2 is a cross sectional view taken on the line 2—2 of FIG. 1.

FIG. 5 is a front elevation of the back plate of the basic frame.

FIG. 6 is a cross sectional view thereof taken on the line 6—6 of FIG. 5.

FIG. 9 is an elevational view of the back pan with an easel member in place, parts being shown in cross section.

DETAILED DESCRIPTION

Figures 1, 3, 4:
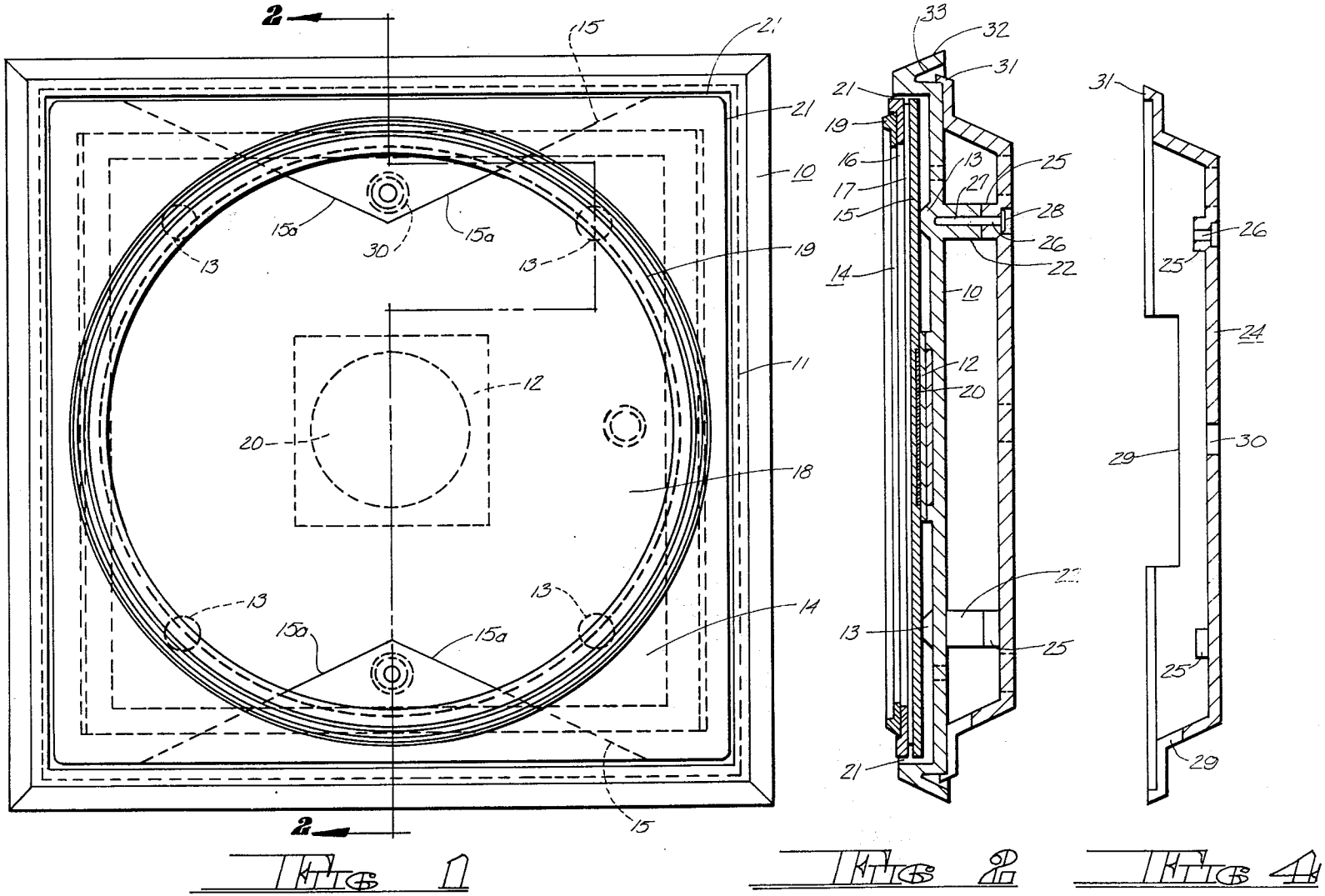
FIG. 1 is a front elevational view of the complete frame according to the invention.
FIG. 3 is a front elevational view of the back pan.
FIG. 4 is a cross sectional view of the back pan taken on the line 4—4 of FIG. 3.

The basic frame which is composed of two pieces is described in considerable detail in said copending application and reference may be had thereto for a complete description thereof. For the present purposes, it is enough to say that the frame consists of a back plate 10 shown in detail in FIGS. 5 and 6. The back plate is recessed and the recess is surrounded by a bezel 11. A magnetic element 12 is secured in the recess centrally thereof and a number of projections are disposed about the member 12 as indicated at 13.

The front plate is generally indicated at 14 and comprises a rear surface element 15 and a front surface element 16 suitably spaced apart to provide therebetween a slot for the insertion of a photograph. The front surface member 16 is provided with an opening 18 through which the photograph may be viewed and the opening may be surrounded by a decorative or ornamental bezel 19. The member 15 may have the opening defined by the lines 15*a* in FIG. 1 to facilitate the insertion and removal of a photograph in the space 17.

Substantially centrally of the rear face member 15 there is provided a metallic element 20 which cooperates with the magnetic element 12 mentioned above. Preferably the height of the magnetic element 12 from the floor of the back plate 10 is substantially the same as the height of the abutments or posts 13 so that the front plate 15 is held magnetically with the rear surface of the front plate 15 also resting on the posts 13. This provides for a solid hold.

From a consideration of FIGS. 1 and 2, it will also be noted that the front plate member 16 fits within the back plate member 15 with clearance as indicated at 21. With the parts as shown in FIGS. 1 and 2, it is fairly easy to change pictures in the frame. It is only necessary to press down on the front plate member 16 near an edge and the front plate member will then tilt on one or more of the posts 13 as a fulcrum and the plate may then be grasped at the opposite side and removed from the back plate member 10. Photographs may readily be slid in and out of the front plate member 16 by virtue of the openings 15.

Thus far the description relates substantially to the frame as disclosed in said copending application. According to the present invention the back plate member 10 is slightly modified by the provision of rearwardly extending posts 22 which may be aligned with the posts 13, and which provide for the attachment of a back pan 24 shown in detail in FIGS. 3 and 4. The back pan 24 is provided with the abutments 25 which are aligned with the posts 22 and they are drilled and countersunk as indicated at 26. The posts 22 are likewise drilled as at 27. Thus the back pan 24 may be secured to the back plate 15 by means of screws 28.

The back pan is provided with the recesses 29, one on each of the sides of the back pan. Preferably the back pan also is provided with the holes 30. It will be understood that the hole 30 may be provided in the same relative position adjacent the other recesses 29.

It will be noted that the back pan 24 preferably has a flange 31 and that the back plate 10 preferably has the flange 32 providing a recess 33. In assembly the flange 31 engages in the recess 33 snugly to define the position of the back pan 24 with respect to the back plate 10. When so assembled, the holes 26 and 27 are aligned and the parts may then be fastened together by means of the screws 28.

Figure 8:
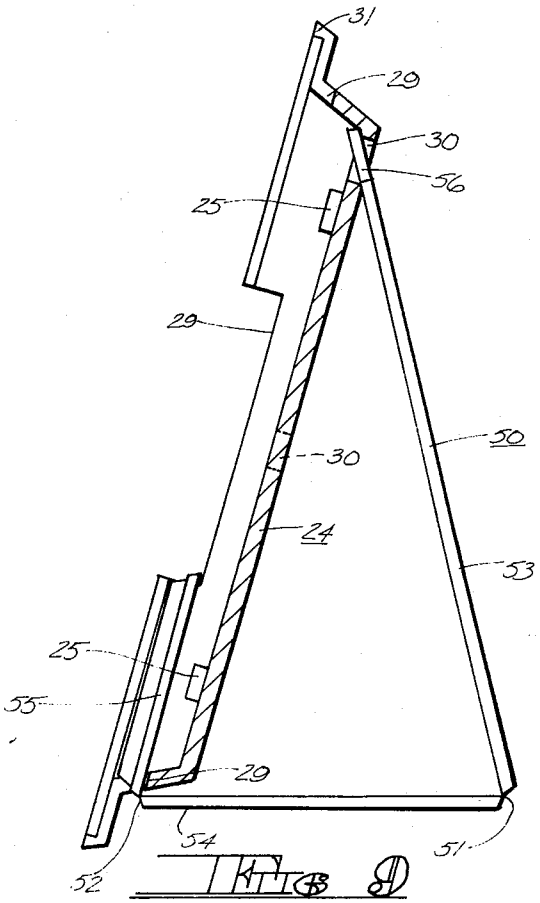
FIG. 8 is an end elevational view as seen from the top of FIG. 7.
Figure 7:
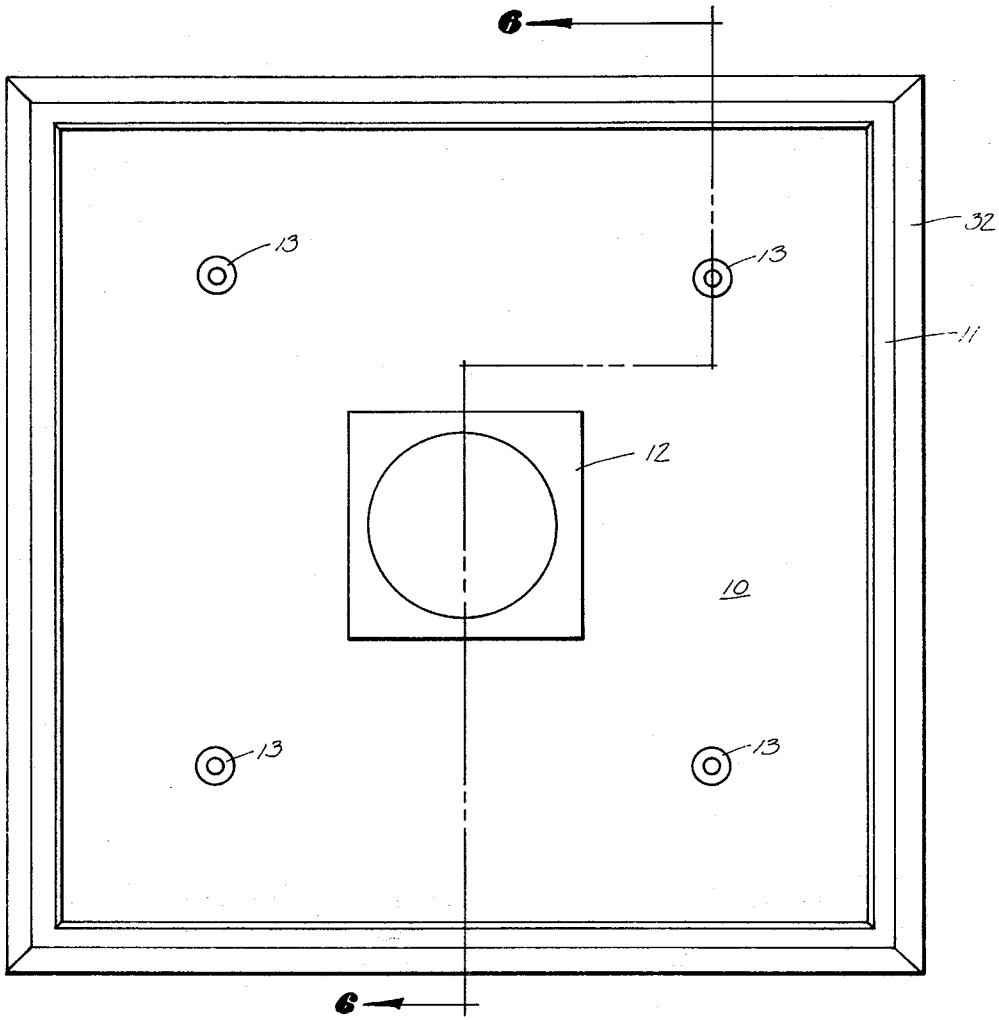
FIG. 7 is a front elevational view of a message standard adapted to be used with the frame.
Figure 10:
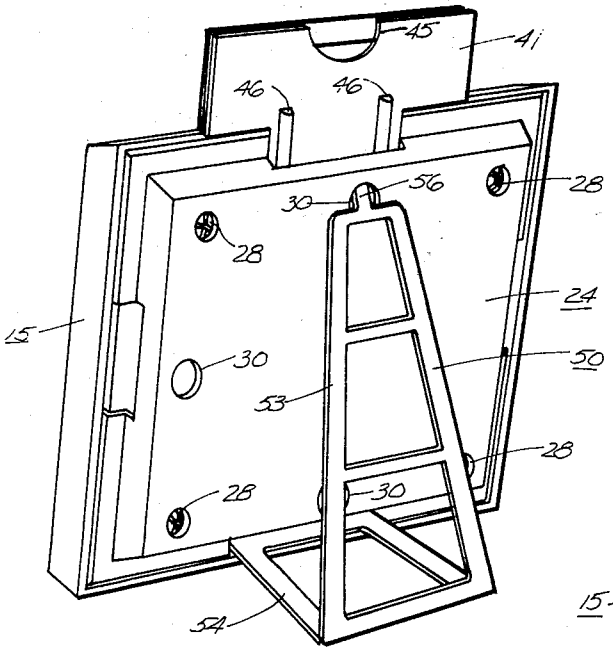
FIG. 10 is a rear perspective view of the complete frame with the back pan, easel and message standard.
Figure 12:
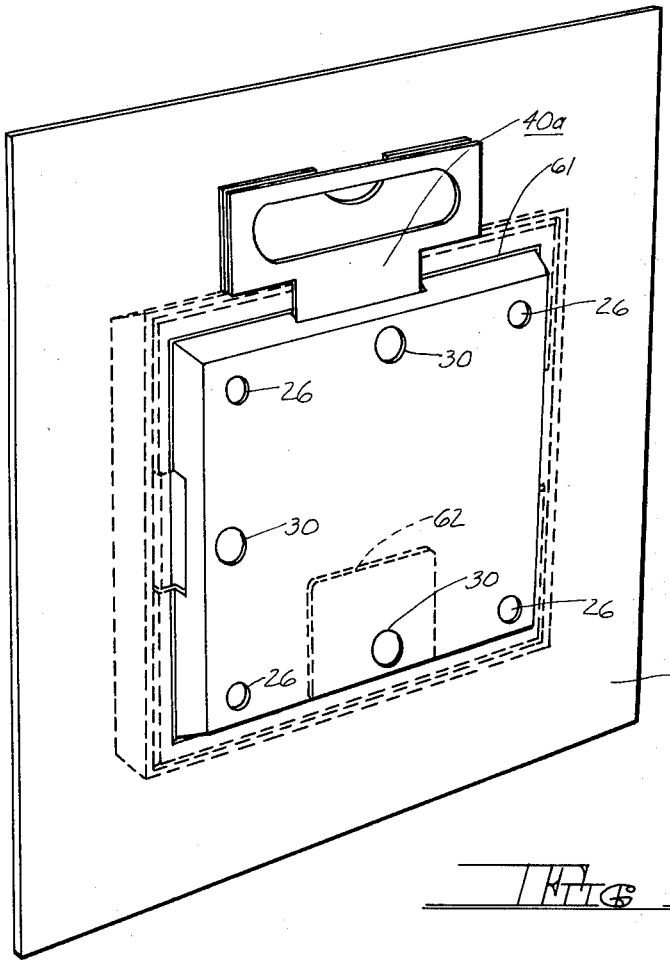
FIG. 12 is a perspective view from the rear of a frame mounted on a card.
Figure 13:
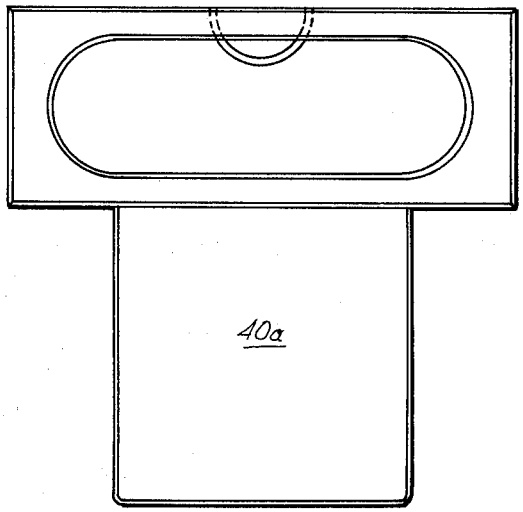
FIG. 13 is an elevational view of a modified message standard for use with a card as in FIG. 12.

The provision of the back pan according to the present invention makes possible the use of a number of accessories. Thus, there may be provided a message standard indicated generally at 40 in FIGS. 7 and 8. The standard 40 preferably consists of two pieces — a T-shaped member 41 and a front member 42 having an opening 43 through which a message may be displayed. It will be understood, from a consideration of FIG. 8, that the members 41 and 42 are spaced apart by spacers 44 and a finger opening is provided at 45 in the member 41. Thus, a small card may be slipped into the standard and may bear any suitable name or message. The member 41 is provided in its lower portion with the ribs 46 whereby it may be inserted and will fit snugly in one of the recesses 29 as best seen in the rear views in FIGS. 10 and 11.

The provision of the recesses 29 together with the provision of the holes 30 in the back pan member make possible the addition of an easel member as shown in FIG. 9. The easel member is indicated generally at 50. It may be suitably made from a plastic material such as polyethylene and be provided with transverse notches as at 51 and 52 to provide fold points whereby it may be bent into three angularly related parts, the main easel portion being indicated at 53, the base portion at 54 and another portion at 55 which may be inserted upward into one of the recesses 29. The upper end of the portion 50 is reduced in width to provide a tongue 56 which may be inserted through the appropriate hole 30. The easel member 50 may be molded in the configuration best seen in the rear view of FIG. 10 in order to save material.

Figure 11:
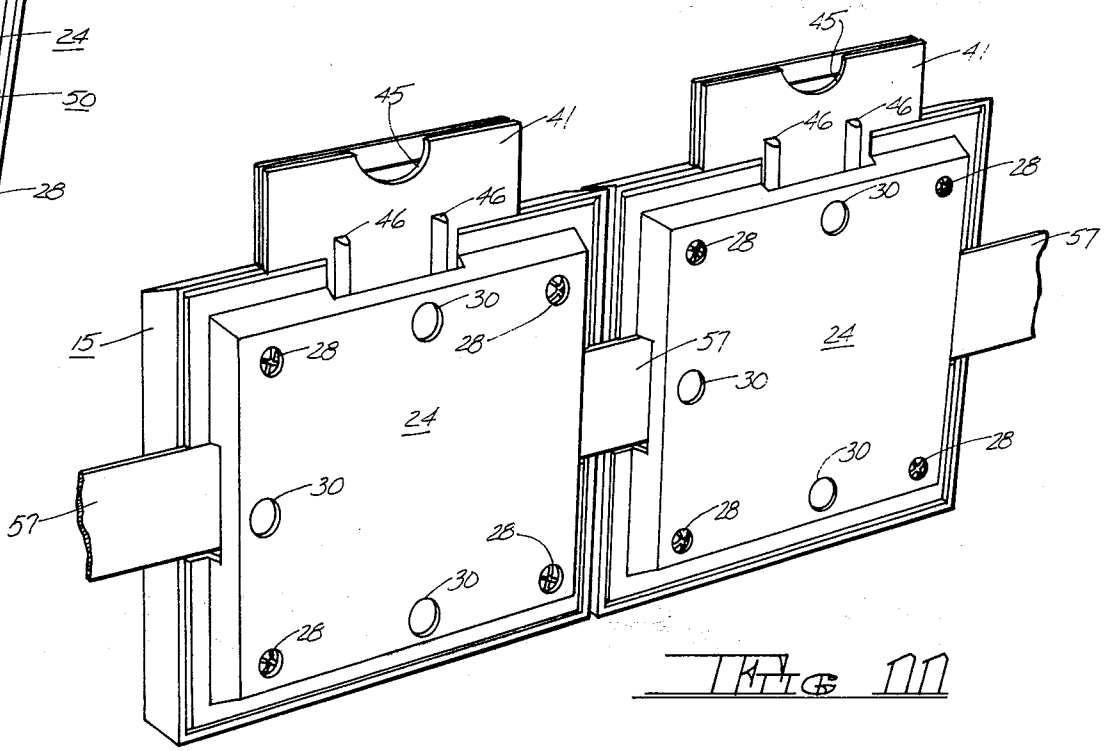
FIG. 11 is a rear perspective view of two like frames mounted on a common rail.

The recesses 29 also make it possible to mount a plurality of frames on a single rail as indicated at 57 in FIG. 11. The rail will of course be of such width and thickness as to pass snugly through opposed recesses 29 and a plurality of frames may thus be mounted on the rail 57. The rail 57 may of course be disposed in a vertical position in which case a fastening device may be inserted through one of the holes 30 in the back pan and against or through the rail 57. The rail 57 may be of any configuration, i.e. it need not be straight but may be curved as desired.

Yet another accessory which may be used with the present invention comprises a paperboard background member 60. The card 60 is provided with a cut-out 61 of such size that the back pan will fit thereinto with the recesses 29 emerging behind the card. The card will be provided with a tab 62 extending upward from the bottom of the cut-out and this tab engages in one of the recesses 29.

In mounting the frame on the card, the member 62 is introduced into the recess 29 at the bottom of the frame and the frame is then swung into the opening 61 and a slightly modified legend standard **40*a* is then inserted behind the card in the opposite recess 29** to hold the frame in position on the card.

The member **40*a* may be exactly the same as the member 40 with the exception that the ribs 46 are eliminated, so that the portion 41 represents a plane surface. This surface is placed against the back of the card 60.**

The card on its front face may be printed with any suitable design or other legend or message.

While the frame shown in the drawings has a circular opening for display of photographs, it will be understood that other front plate members 16 may be provided and these may have square, rectangular, or oval or other configurations of openings. With a supply of several front plates 16 with differently configured picture openings it is possible not only to change the picture but to change the form of the display.

It will be clear that numerous modifications may be made without departing from the spirit of the invention. Therefore no limitation not expressly set forth in the claims is intended and no such limitation should be implied.

The embodiments of the invention in which an exclusive property or privilege is claimed are defined as follows:

1. In combination with a photo frame and the like, a back pan having a back surface, and side walls extending between said back surface and said frame, and removably secured to the rear of said frame, said back pan having a recess in each side wall, each said recess providing a slot between said back pan and the rear of said frame, said back pan having a hole centrally disposed on at least two adjacent sides near said recesses.

2. The combination of claim 1 wherein said frame is a two-piece frame comprising a recessed rear plate, and an apertured front plate provided with a slot for the insertion of a photo, said front plate fitting within said recess with clearance thereabout, and magnetic means for releasably retaining said front plate in said recess.

3. In the combination of claim 1, an easel member comprising an elongated element having a long section, a relatively shorter section, and a yet shorter section, said sections being hingedly arranged with respect to each other, said long section terminating in a tongue of a size to enter one of said holes, and said yet shorter section being of dimensions to fit into one of said slots opposite said one hole.

4. In the combination of claim 1, a message standard of generally T-shape having a main leg of dimensions to fit in one of said slots, and a cross leg having an apertured message frame secured thereto in spaced relation, to permit insertion of a card bearing a message.

* * * * *